United States Patent [19]

Peterson et al.

[11] 3,949,879

[45] Apr. 13, 1976

[54] PROTECTIVE PACKING PRODUCT

[75] Inventors: Dean M. Peterson, Littleton; Franklin P. Elliott, Denver, both of Colo.

[73] Assignee: Honeywell Inc., Minneapolis, Minn.

[22] Filed: Dec. 11, 1974

[21] Appl. No.: 531,623

[52] U.S. Cl. ..... 206/522; 5/348 R; 229/14 C

[51] Int. Cl.[2]A47C 27/08; B65D 81/14; B65D 85/30

[58] Field of Search ..... 5/348 R, 349, 355, 359; 206/521–523; 229/14 C, 62.5; 267/117, 142, 145–146; 428/188

[56] References Cited

UNITED STATES PATENTS

| | | | |
|---|---|---|---|
| 2,837,145 | 6/1958 | Goetz | 5/348 R |
| 3,128,480 | 4/1964 | Lineback | 5/348 R |
| 3,346,101 | 10/1967 | Pestka | 206/522 |

FOREIGN PATENTS OR APPLICATIONS

| | | | |
|---|---|---|---|
| 1,000,728 | 10/1951 | France | 206/522 |
| 1,243,218 | 8/1960 | France | 5/349 |

*Primary Examiner*—Steven E. Lipman
*Attorney, Agent, or Firm*—H. L. Hanson; C. J. Ungemach

[57] ABSTRACT

A protective packing product is formed of a pair of flexible plastic wall members sealed together around the periphery thereof to define a hollow air pocket therebetween. Resilient structure is provided within the air pocket, tending to maintain the capsule thus formed in a fully puffed condition. Air-bleed perforations are provided through the walls of the capsule whereby the capsule may tend to collapse with a damped cushioning protection for a protected instrumentality.

1 Claim, 7 Drawing Figures

PROTECTIVE PACKING PRODUCT

BACKGROUND OF THE INVENTION

1. Field of the Invention

The present invention relates to a protective packing product and more particularly to improved structure for pneumatic cushioning material for protecting delicate members from damage due to impact.

2. Description of Prior Art

There has been a perennial problem of providing protective packing products for delicate devices during transit of such devices. Attempts at solving the problem have run the gamut from crumpled newspaper and excelsior to more modern formed, foamed plastics. Included in the earlier efforts to provide such protective packing material is sheet-formed plastic material of two sheets of thin, pliable plastic, selectively sealed together with a plurality of pockets of air or bubbles formed therein. Each of the foregoing means has had significant shortcomings. Although all of the prior means provide some measure of protection against transit damage, none have been highly successful in affording protection agsinst high impact shock. It appears that each of the previous solutions provide a measure of initial resilience. That initial resilience is not sufficient to afford protection against high impact shock.

SUMMARY OF THE INVENTION

Accordingly, it is an object of the present invention to provide an improved protective packing product which overcomes the shortcomings of previous packing material.

It is another object of the present invention to provide an improved packaging product as set forth which affords a higher order of high impact shock protection.

In accomplishing these and other objects, there has been provided, in accordance with the present invention, a cellular plastic structure having trapped air within the cells providing basic resilience but having small perforations to allow at least a portion of the trapped air to escape under impact condition to effect a damped cushioning of the protected objects.

BRIEF DESCRIPTION OF THE DRAWINGS

A better understanding of the present invention may be had from the following detailed description when read in connection with the accompanying drawings, in which.

DESCRIPTION OF THE PREFERRED EMBODIMENTS

Figure 1:
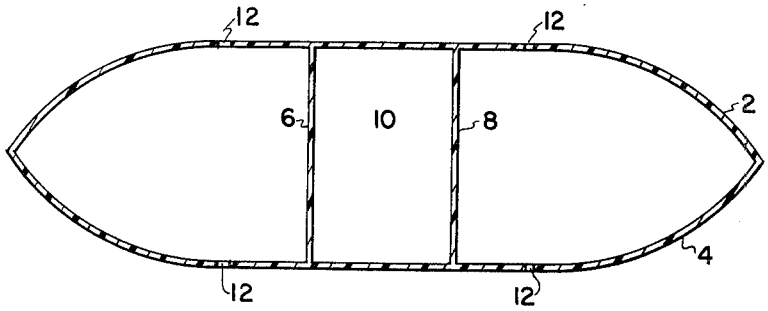
FIG. 1 is a cross-sectional view of a cushioning structure in accordance with the present invention.

Referring now, to the drawings in more detail, there is shown in FIG. 1 an elementary cushioning structure embodying the present invention. The structure includes an envelope formed of a first wall member 2 and a second wall member 4 of a suitable plastic material such as polyethylene. The edges of the two wall members are sealed together to form and define a hollow air pocket therebetween. A first rib 6 and a second rib 8 are positioned in spaced relation to each other and bridging between the first and second wall members 2 and 4, respectively. The edges of the rib members 6 and 8 are sealed to the inner surfaces of the wall members 2 and 4. The rib members 6 and 8 are longitudinally coextensive with the inner surface of the wall members 2 and 4. Therefore, the sealing of the edges of the rib members to the inner surface of the wall members defines an inner air chamber 10 within the air pocket defined by the two wall members 2 and 4. There are small air-bleed perforations 12 provided through the wall members 2 and 4. These perforations or orifices 12 are so located as to be exterior of the inner air chamber 10. Thus, the inner air chamber 10 is and remains a completely sealed compartment while the outer portions of the air pocket defined by the wall members 2 and 4 each comprise a perforated air pocket.

Figure 2:
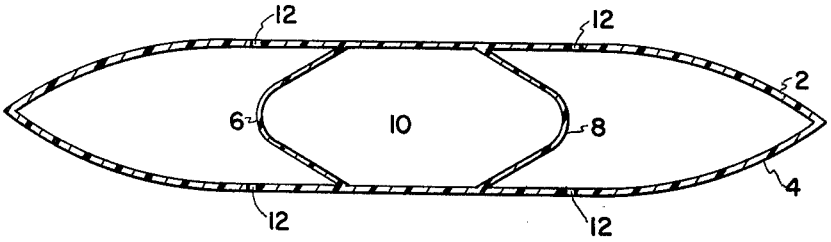
FIG. 2 is a cross-sectional view of the structure of FIG. 1 but in a partially collapsed condition.

The sealed inner air chamber 10 serves as a resilient restoring element tending to maintain the cushioning capsule in its fully extended position as shown in FIG. 1. Under applied pressure from an external force, the capsule tends to collapse. The inner air chamber 10, being sealed, must respond by deformation of the contour of the rib members 6 and 8, as shown in FIG. 2, while maintaining the volume substantially constant. The air pockets exterior of the inner air chamber 10, being perforate, tend to collapse with the entrapped air escaping through the perforations 12. The perforations 12 are relatively small. Therefore, the air escaping therethrough provides a damped cushioning effect by the capsules for whatever instrumentality applies the external force.

Thus, when a delicate instrumentality is packed in a carton and protected by cushioning capsules of the type herein described, for ordinary jolts and jars, the cushioning capsules respond in a traditional manner to provide the usual resilient protection. When, however, the carton is subjected to extraordinary or high impact shock, the cushioning capsules act as a damped resilience to absorb the added shock that would otherwise be damaging to the protected instrument if conventional resilient cushioning had been used.

Figure 3:
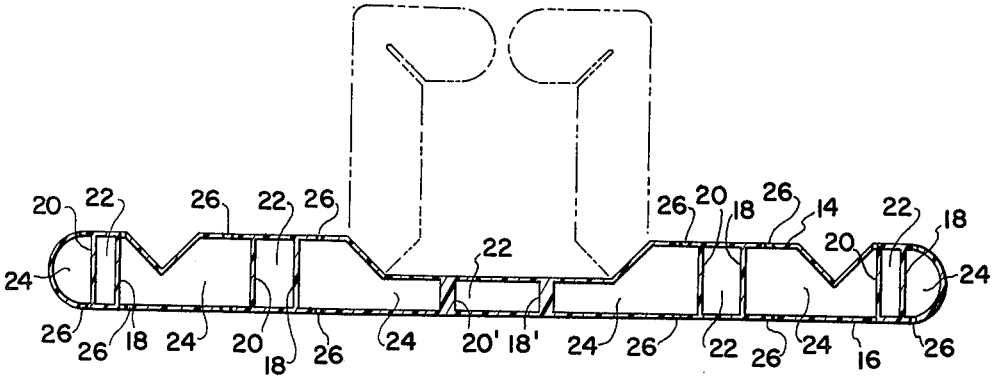
FIG. 3 is a cross-sectional view of a structure similar in structure to that shown in FIG. 1 but somewhat more complex in nature.

The structure shown in FIG. 3 is an extension of the structure shown in FIGS. 1 and 2. That structure is illustrative of the adaptability of the inventive concept to a preformed cushioning capsule structure suitable for the protective encompassment of predetermined articles of manufacture. In FIG. 3, a structure is shown which includes a plurality contiguous air chambers which are alternately sealed and perforated. As before, a first wall member 14 and a second wall member 16 are sealed around their periphery to provide an air pocket therebetween. A plurality of pairs of rib members 18 and 20 define sealed inner air chambers 22. As before, those portions 24 of the air pocket exterior of the air chambers 22 are perforate, having orifices 26 through the first and second wall members. The first wall member 14 is preformed with suitable contours to render the capsule structure readily foldable, as shown in dotted line, to embrace a predetermined product. At the center portion of the structure the ribs 18' and 20' defining the centermost sealed air chamber 22 may, if desired, be made somewhat thicker than the other ribs 18 and 20 to provide a measure of greater support for the bottom of a relatively heavy protected instrumentality under sustained load conditions of storage.

Figure 4:
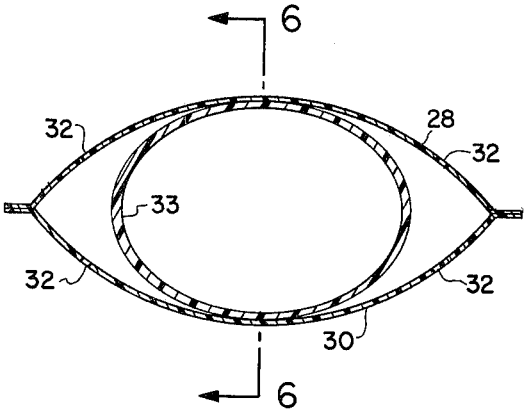
FIG. 4 is a cross-sectional view of a different form of cushioning structure also embodying the present invention.
Figure 5:
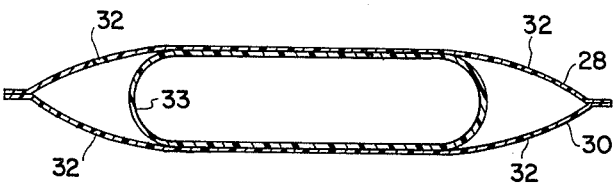
FIG. 5 is a cross-sectional view of the structure of FIG. 4 but in a partially collapsed condition.
Figure 6:
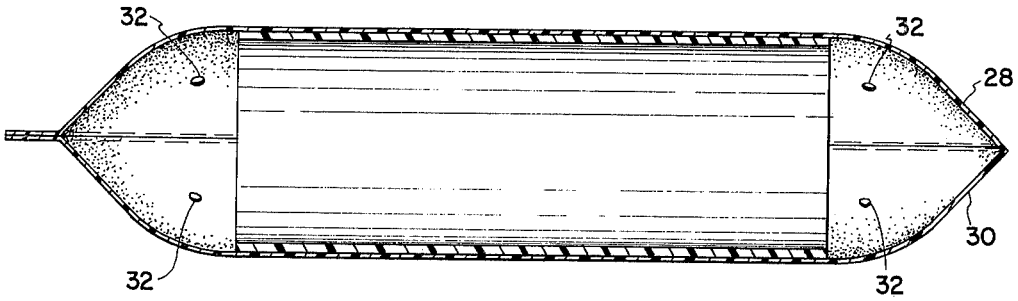
FIG. 6 is a longitudinal cross-sectional view of the structure shown in FIG. 4 taken along the line 6—6.

A somewhat different structure is shown in FIGS. 4, 5 and 6 which also embodies the present invention. Here, again, a capsule is formed from a first wall member 28 and a second wall member 30. The two wall members are sealed together about their periphery to define an air pocket therebetween. The wall members 28 and 30 have one or more perforations or orifices 32 to allow the entrapped air to escape and return. A resilient member 33, such as a tube of a suitable plastic, is encapsulated within the air pocket. The tube member 33 is of sufficient stiffness to tend to return the capsule to a fully puffed condition as is shown in FIG. 4. When, as described in connection with FIGS. 1 to 3, an instrumentality protected by such cushioning means is subjected to a high impact shock, the capsule will tend to collapse to a condition such as is shown in FIG. 5 with the entrapped air escaping through the orifices 32, thereby providing a damped cushioning protection for the associated instrumentality.

Figure 7:
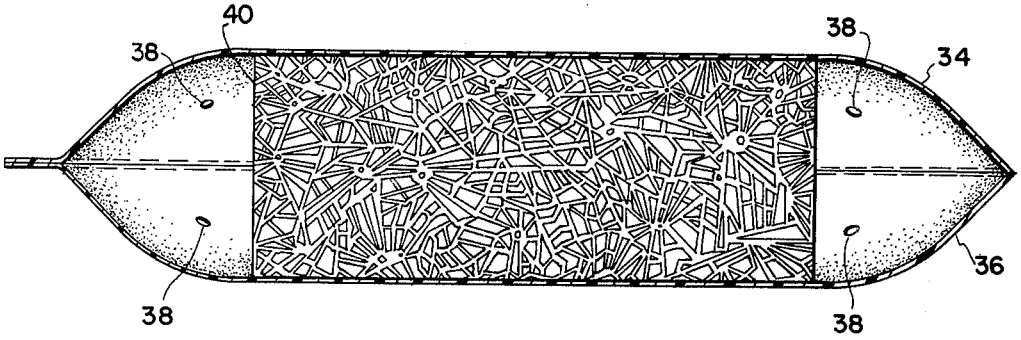
FIG. 7 is a cross-sectional view of another form of cushioning structure also embodying the present invention.

In FIG. 7, there is shown another structure embodying the present invention. The structure there shown is similar to that shown in FIGS. 4, 5 and 6 with the principal differences in the form of the encapsulated resilient member. The capsule is formed of a first wall member 34 and a second wall member 36 with the two wall members sealed together around the periphery thereof. These wall members are provided with one or more bleed orifices 38. The encapsulated resilient member 40 is formed of a non-cellular sponge material such as polyurethane foam. In this construction, the plastic foam insert tends to maintain the cushioning capsule in a fully puffed condition. It, too, will allow the capsule to collapse in response to an externally applied force.

As before, the bleed orifices provide a damped collapse of the capsule.

While this invention has thus far been described as it relates to the protective packing of delicate instruments, or the like, it will be apparent to those skilled in the art that protective packing products constructed in accordance with the present invention are also useful in the field of protective clothing, such as liners for football helmets, crash helmets, or body protecting padding, such as are used by football players and other participants in body contact activities. Another area where such protective packing material may be useful is in the protective padding of the critical portions of the interior of motor vehicles, including automobiles and airplanes.

The embodiments of the invention in which an exclusive property or privilege is claimed are defined as follows:

1. A protective packing product comprising a thin walled plastic structure having first and second wall members;

said first and second wall members being sealed together to define an air pocket therebetween;

resilient means between said sealed wall members positioned to tend to maintain said first and second wall members in spaced relationship with respect to each other, said resilient means comprising an imperforate air chamber formed of first and second spaced transverse wall members sealed to said first mentioned wall members, said imperforate air chamber being of substantially smaller dimensions than said air pocket between said first mentioned wall members, and at least one of said first mentioned wall members having at least one air-bleed orifice therein, said air-bleed orifice providing a passage through which air may escape from said air pocket when pressure is applied to said structure, said air-bleed orifice being positioned externally of said air chamber, said product thereby providing a damped resilience protection.

* * * * *